US006390061B1

(12) United States Patent
Melville et al.

(10) Patent No.: US 6,390,061 B1
(45) Date of Patent: May 21, 2002

(54) MAGNETIC LINEAR ACTUATOR FOR CONTROLLING ENGINE SPEED

(75) Inventors: James A. Melville, Rochester; Peter M. Herman, Oronoco; Robert A. Rink; James M. Rigotti, both of Rochester, all of MN (US)

(73) Assignee: Pemstar, Inc., Rochester, MN (US)

( * ) Notice: Subject to any disclaimer, the term of this patent is extended or adjusted under 35 U.S.C. 154(b) by 0 days.

(21) Appl. No.: 09/544,594

(22) Filed: Apr. 6, 2000

Related U.S. Application Data

(60) Provisional application No. 60/128,128, filed on Apr. 7, 1999.

(51) Int. Cl.[7] ..... F02D 9/14; F02D 9/16

(52) U.S. Cl. ..... 123/353; 123/361; 123/399

(58) Field of Search ..... 123/352, 353, 123/354, 361, 399, 339.27

(56) References Cited

U.S. PATENT DOCUMENTS 4,453,517 A * 6/1984 Kasiewicz ..... 123/352
4,781,161 A * 11/1988 Sausner et al. ..... 123/339.27
4,875,447 A * 10/1989 Kiuchi et al. ..... 123/339.27
4,884,541 A * 12/1989 Marriott ..... 123/361
4,989,564 A * 2/1991 Cook et al. ..... 123/339.27
5,003,948 A * 4/1991 Churchill et al. ..... 123/361
5,031,593 A * 7/1991 Erhard et al. ..... 123/361
5,394,954 A * 3/1995 Tashiro et al. ..... 123/361

* cited by examiner

*Primary Examiner*—Erick Solis
(74) *Attorney, Agent, or Firm*—Dorsey & Whitney LLP

(57) ABSTRACT

The present invention provides a cost-effective method and apparatus for controlling engine speed. One embodiment generally comprises a controller and a linear actuator. The controller generates a plurality of voltage pulses having a duration and frequency related to a difference between a desired engine speed and an actual engine speed. The linear actuator converts the plurality of voltage pulses into a throttle position.

8 Claims, 7 Drawing Sheets

MAGNETIC LINEAR ACTUATOR FOR CONTROLLING ENGINE SPEED

RELATED APPLICATIONS

This application claims priority from Provisional Application Number 60/128,128, filed Apr. 7, 1999.

BACKGROUND

The present invention relates an automatic control method and apparatus. More particularly, the present invention relates to a method and apparatus for controlling the speed of an internal combustion engine by using a pulse width modulator ("PWM") to drive a magnetic linear actuator.

Small internal combustion engines ("IC engines") are lightweight and inexpensive power sources. These features make small IC engines an attractive choice for portable electric generators. These generators are commonly used to provide electric power in places without access to the national electric grid, and are particularly popular for use on construction sites, in recreational vehicles in remote areas, and during power outages.

One problem with the use of IC engines in portable generators, however, is that many electrical appliances require alternating current at almost exactly 60 hertz. Specifically, current specifications require a frequency variance of about ±3 to 5 hertz without load and while loading, and a steady state frequency variance of about ±0.6 to 0.8 hertz under load. Meeting these specifications requires that the speed of the IC engine be very accurately controlled.

A conventional solution to this speed control issue is to use a mechanical governor. One such governor slidably attaches a fan blade to the engine's output shaft. As the motor accelerates, the fan begins to generate an axial force. This axial force biases the fan blade against a spring. The resulting relative motion is related to the fan's angular velocity and can be used to actuate the engine's throttle position. Another type of governor pivotally attaches weights to a rotating shaft. The resulting centripetal force pivots the weights radially outward against gravity or against a spring. The angle between the weights and the shaft is related to the shaft's angular velocity and is used to actuate the engine's throttle position.

Although mechanical governors are relatively inexpensive, they generally respond slowly to changes in the engine's load. This problem is particularly burdensome in portable generator applications because many common electrical loads (e.g., heaters, hair dryers, and incandescent lamps) are applied and removed instantaneously. This instantaneous change in load, combined with the mechanical governor's slow response time, can result in unacceptable deviation from the desired frequency.

One partial solution to this response time problem is to reduce damping within the governor. This solution, however, can lead to overshoot and undershoot problems, and other unacceptable variations. Another partial solution to this response time problem uses a small electric motor to control a throttle valve. This system, however, is complex and expensive, which makes it uneconomical for use in the small portable generators.

Clearly, there is a need for a cost-effective control method and apparatus that can maintain a constant engine speed and that can rapidly respond to load changes with minimal overshoot or undershoot. There is also a need for a speed control device that is capable of proportional, integral, or differential control of a single or a multi-cylinder IC engine.

SUMMARY

The present invention provides a cost-effective controller that can maintain a constant engine speed and can rapidly respond to load changes with minimal overshoot or undershoot. One embodiment generally comprises a controller and a linear actuator. The controller generates a plurality of voltage pulses having a duration and a frequency related to the difference between a desired engine speed and an actual engine speed. The linear actuator in some embodiments comprises of a magnet associated with an actuator rod and a solenoid coil. The plurality of voltage pulses generate a current in the solenoid coil, which creates a magnetic field. The magnet interacts with magnetic field interacts to generate an actuating force. This actuating force biases the actuator rod in a first direction.

Some embodiments of this invention enclose the linear actuator in a ferrous metal housing. Hysteresis effects in this housing generate a return force that biases the actuator rod in a second direction, opposite of the first direction. This return force will cause the throttle to automatically close in the event of a power failure, thereby creating an automatic fail safe feature. Still other embodiments of this invention replace the ferrous metal housing with a housing made from an appropriate nonferrous material, such as a plastic, and use a return spring to close the throttle.

Another embodiment of the present invention comprises a controller operatively connected to an engine speed sensor and adapted to produce a signal related to the difference between an actual engine speed and a desired engine speed; a pulse width modulator that generates a plurality of voltage pulses having a duration and frequency related to the signal from the controller; and a linear actuator assembly that converts the plurality of voltage pulses into a throttle position. The linear actuator assembly, in turn, comprises a solenoid coil, electrically coupled to the pulse width modulator, that generates a linear actuation force during the plurality of voltage pulses, wherein the linear actuation force translates an actuator rod in a first direction; a linkage that couples the actuator rod to a throttle valve; and a biasing element adapted to generate a return force between the plurality of voltage pulses, wherein the return force translates the actuator rod in a second direction.

Another aspect of the present invention is a method of controlling engine speed. One embodiment of this method comprises generating a plurality of voltage pulses having a duration and a frequency related to a difference between a desired engine speed and an actual engine speed, wherein the plurality of voltage pulses drive a linear actuator; and actuating a throttle valve with the linear actuator. The method may further comprise generating a pulse width counter value and a terminal value; establishing a counter for storing values used in performing iteration; setting the counter to the pulse width counter value; iteratively decrementing the counter while the counter is greater than the terminal value; and changing an output state of a pulse width modulator.

One feature and advantage of the present invention is its low cost. This feature allows it to be economically used to control small portable generators. Another feature and advantage is that a fail safe feature automatically shuts the IC engine off in the event of a power failure, or other malfunction, in the control circuitry. Still another feature of the present invention is that it minimizes the amount of hardware necessary for implementation, which reduces both board real estate and component costs. These and other features, aspects, and advantages of the present invention will become better understood with reference to the following description, appended claims, and accompanying drawings.

DETAILED DESCRIPTION

Figure 1:
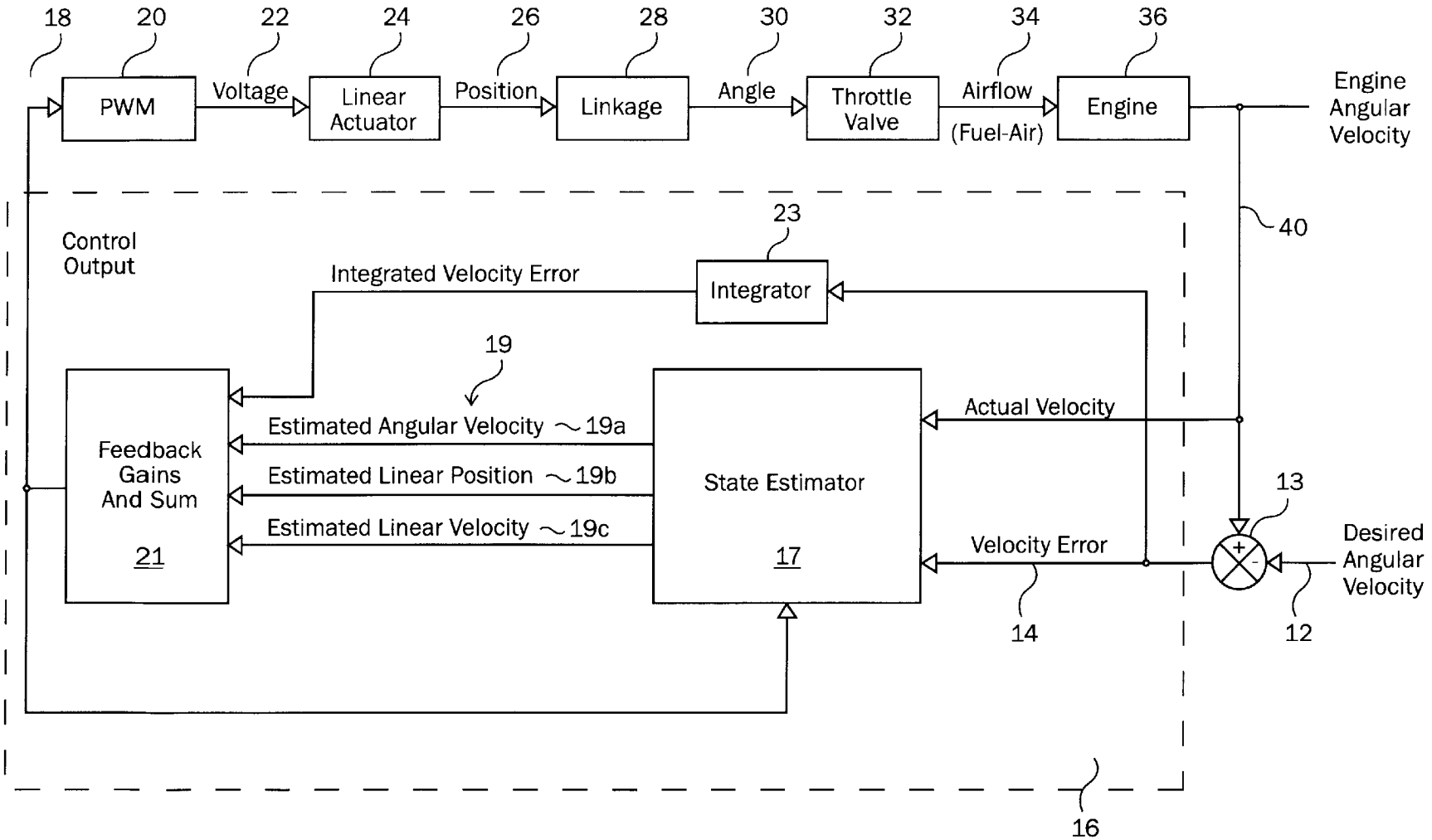
FIG. 1 is a block diagram showing a feedback control system embodiment.

FIG. 1 shows one embodiment of an apparatus 10 for controlling the speed (often measured in revolutions per minute, or "RPM") of an internal combustion engine 36. The apparatus 10 comprises a feedback controller 16, a variable PWM 20, a magnetic linear actuator 24, a linkage 28, and a butterfly style throttle valve 32.

In operation, the feedback controller 16 generates an output control signal 18 from a desired speed signal 12 ("desired angular velocity") and an actual engine speed signal 40 ("engine angular velocity"). The controller 16 can implement a variety of control algorithms using special-purpose hardware, such as an analog network having one or more operational amplifiers ("op-amps"), or a general-purpose microprocessor that executes a software or firmware program. Appropriate control algorithms include, without being limited to: proportional, integral, differential, phase lead, phase lag, feed forward, state variable, or a combination of any or all of these control methods in either analog and/or digital form.

As will be discussed in more detail with reference to FIG. 2, the output signal 18 in this embodiment is a PWM counter value. The PWM counter value is related to the length of time that the PWM 20 should remain in its current output state. That is, the PWM 20 comprises a solid-state switch that alternatively opens and closes. The ratio of open to closed time, known as the "duty cycle," determines an effective voltage 22 applied to the linear actuator 24. The linear actuator 24 converts this effective voltage into a linear position 26, which in turn is converted into a throttle valve position 30 by the linkage 28. The position 30 of the throttle valve 32 controls the amount of air-fuel mixture 34 allowed into the engine 36. Those skilled in the art will recognize that opening the throttle valve 32 will increase engine speed and that closing the throttle valve 32 will decrease engine speed.

The controller 16 embodiment in FIG. 1 is a microprocessor implemented, state-variable system that uses a full order state estimator 17 (often referred to as a "state observer" in control systems literature) to estimate those state variables 19 that are difficult to directly measure (e.g., an actuator linear position 19*b* and an actuator linear velocity 19*c*). The system also comprises a subtraction circuit 13, a state estimator 17, a summing circuit 21, and an integrator 23, all implemented using firmware running on the programed microprocessor.

The state estimator 17 estimates the state variables 19*a*–19*c* by simulating the engine/actuator system with an appropriate mathematical model. This mathematical model is given the same control inputs 18, as the actual engine / actuator system. It is also desirable to give a velocity error signal 14 (i.e., the difference between the engine actual velocity 40 and the desired angular velocity 12) to the state estimator 17 for use as an error signal to keep the model from diverging from reality. The output of the state estimator 17, namely the estimated state variables 19*a*–19*c*, are sent to the summing circuit 21. The summing circuit 21 multiplies each estimated state variable 19*a*–19*c* by a corresponding feedback gain, linearly sums the resulting products, and generates the control output signal 18. Additional information about this type of control system can be found in: *Digital Control of Dynamic Systems*, Gene F. Franklin, J. David Powell, and Michael L. Workman, Second Edition, Addison Wesley, 1994, which is herein incorporated by reference. Those skilled in the art will recognize that this particular controller 16 embodiment achieves a high degree of simplification by using the velocity error signal 14 rather than the absolute speed signal 40, as well as using the assumption that the actual speed is close to the target speed (a valid assumption that is based upon extensive test verification).

Figure 2:
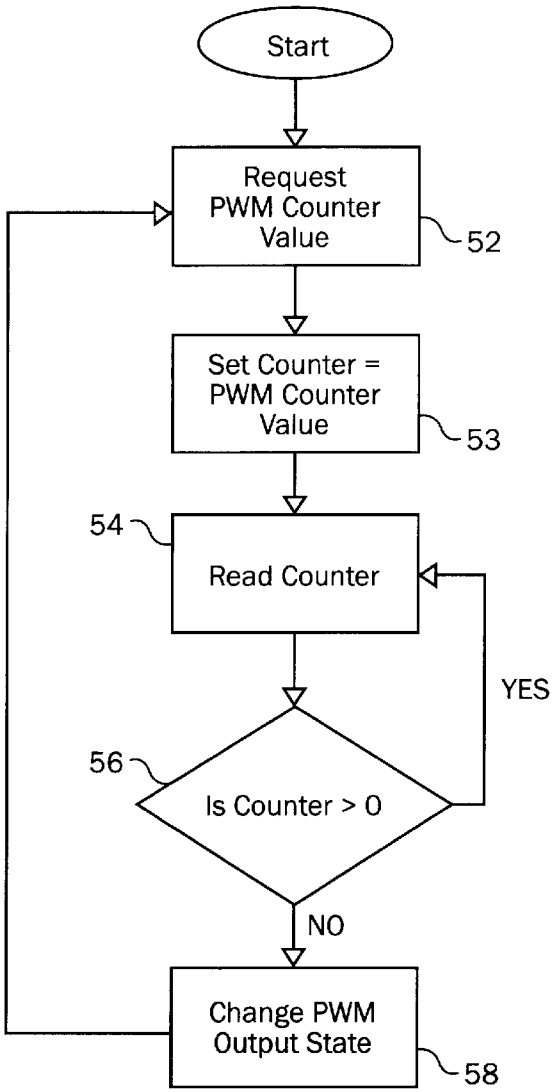
FIG. 2 is a block diagram of one method of generating a voltage pulse of variable duration and frequency.

FIG. 2 is a block diagram of one embodiment of the PWM's driver. At block 52, a microprocessor receives the PWM counter value 18 from the controller 12. This PWM counter value 18 is an integer related to the length of time that the PWM 20 should remain in its current state. At block 53, the microprocessor initializes a counter and sets it equal to the PWM counter value 18. This counter automatically decrements at a known, constant rate. At block 54, the microprocessor reads the current counter value. At block 56, the microprocessor determines whether the counter is greater than zero. If the counter is greater than zero, the microprocessor repeats block 54. If the counter is less than or equal to zero, the microprocessor reverses the PWM's output state (shown in block 58). That is, the microprocessor will open the circuit in block 58 if the PWM 20 was sending power to the actuator 24 and will close the circuit in block 58 if the PWM 20 not sending power to the actuator 24. The microprocessor than returns to and executes block 52.

The PWM 20 in this embodiment can be any device capable of producing electrical pulses at the desired duration and frequency. Suitable devices include, without being limited to, a PWM driver or a microprocessor operatively connected to a silicon controlled rectifiers ("SCRs") or a bipolar junction transistors ("BJTs"). It is also desirable that the chosen devices have a relatively high cycle frequency in order to prevent the actuator 24 from responding to the PWM's individual open/close cycles. One suitable embodiment uses the block diagram of FIG. 2 to produce voltage pulses having an approximate 2.5 ms duration and an approximate 200 Hz frequency.

Figure 3:
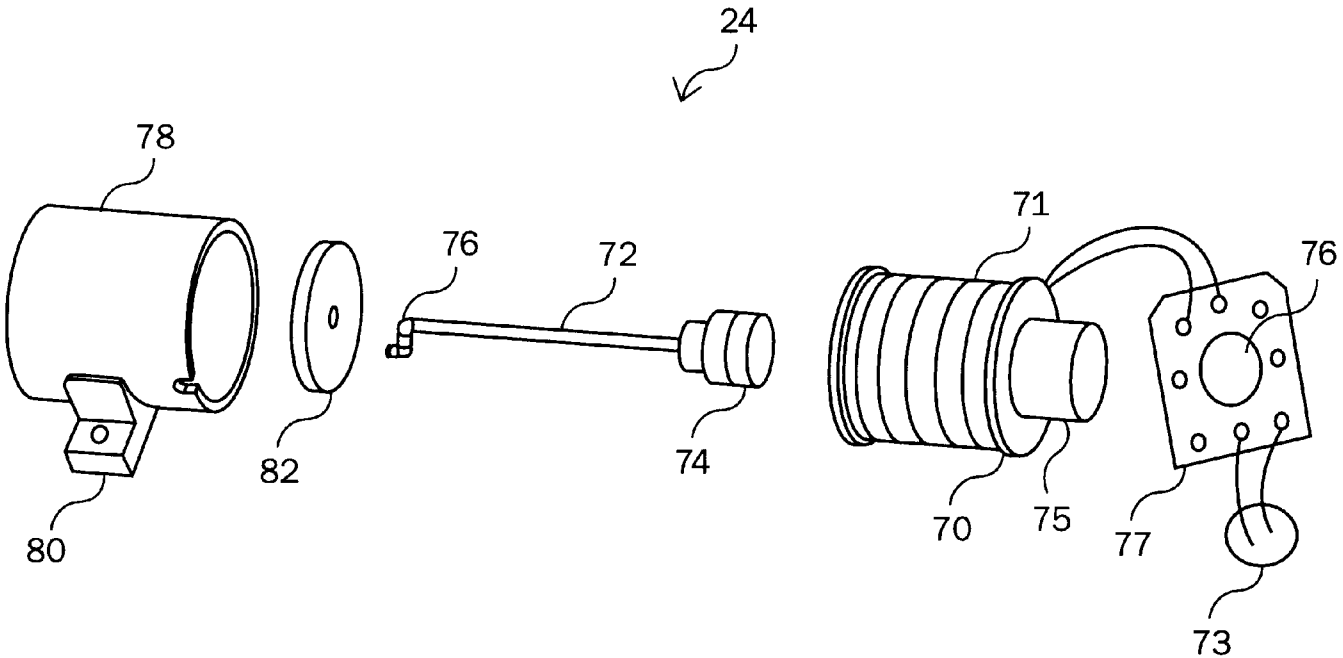
FIG. 3 is an expanded isometric view of a magnetic linear actuator for use in the present invention.

FIG. 3 is an expanded view of the linear actuator 24. The linear actuator 24 comprises a solenoid coil 70 having plurality of windings 71, a generally cylindrical actuator rod 72 having a permanent magnet 74 on one end that slides in a cylinder 75 and a coupling 76 on the other end, and a housing 78 having a base 80 that is adapted to receive attachment bolts and a seal 82. FIG. 3 also shows a control board 77 connected to a power supply 73. The control board 77 in this embodiment contains components of the controller 16 and the PWM 20, and has a central hole 76 that allows the board 77 to be assembled over the cylinder 75 and attached flush to the solenoid coil 70. In addition, the housing 78 can include a seal 82 to protect the magnet 74 and solenoid coil 70 from dirt and debris.

In operation, the PWM 20 sends a voltage pulse 22 to the coil 70. This voltage pulse 22 induces a current in the coil 70, which generates a magnetic flux axial to the coil's windings 71. This magnetic flux interacts with a magnetic flux generated by the permanent magnet 74 and produces an actuator force. The actuator force biases the actuator rod 72 in an axial direction relative to the coil 70.

The actuator rod 72 and the solenoid coil 70 are surrounded and enclosed by the housing 78. In this embodiment, the housing 78 comprises a ferromagnetic material, such as iron or steel. These embodiments are desirable because they automatically shut down the engine 36 if the controller 16 loses power. That is, as the engine runs, the airflow through the carburetor has a bias effect upon the throttle plate that can tend to open the throttle. This effect can cause an engine-over-speed condition to occur if there is a loss of power to the controller 16. In embodiments having a ferrous metal housing 78, however, magnetic reluctance between the magnet 54 and housing will generate a return force after the current stops flowing through the coil 50. This return force biases the actuator rod 72 in the opposite direction as did the voltage from the PWM 20. Accordingly, the return force generated by the magnetic reluctance counteracts the bias effect from the airflow over the throttle plate and causes the engine to shut down in the event of a controller failure. Ferrous metal housings 78 are also desirable because they magnetically shield the linear actuator 24. This benefit allows manufacturers to mount the solenoid coil 70 to the engine 36 by a ferrous metal strap without affecting the actuator's 24 operation.

Figure 6:
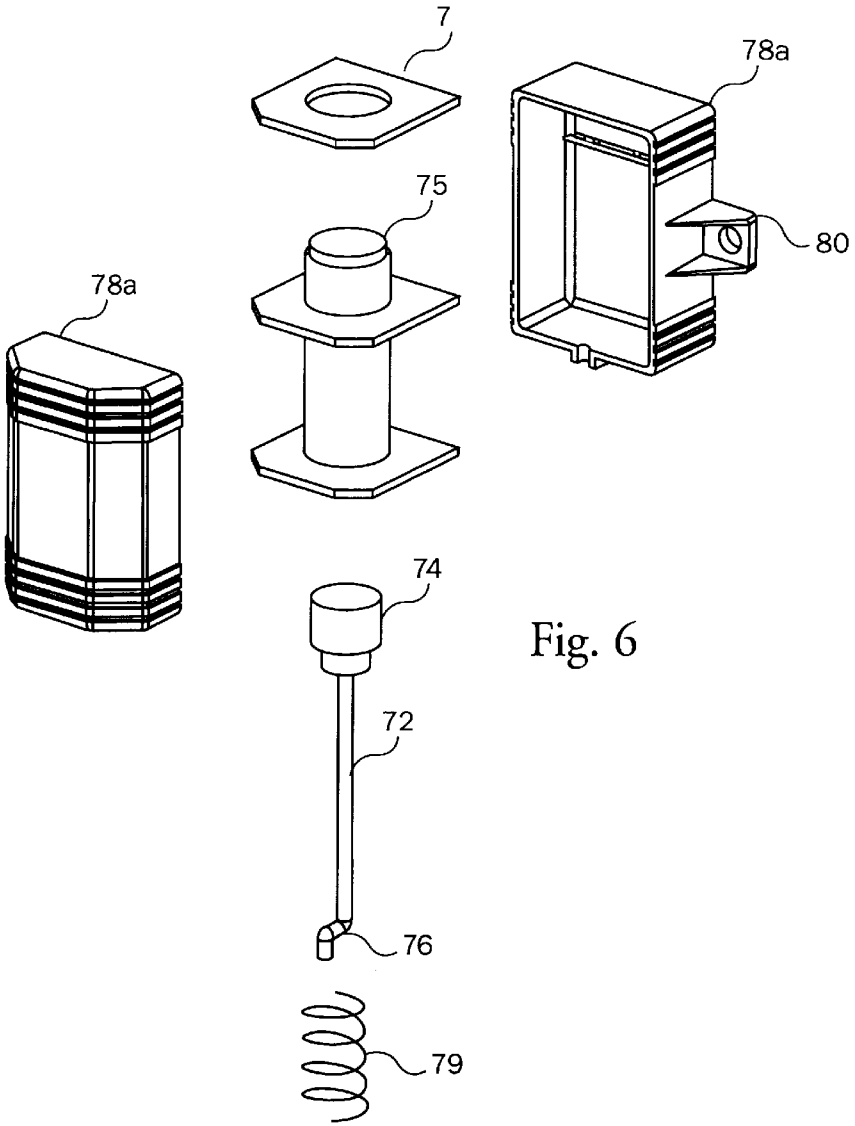
FIG. 6 is an expanded isometric view of the embodiment in FIG. 5.
Figure 5:
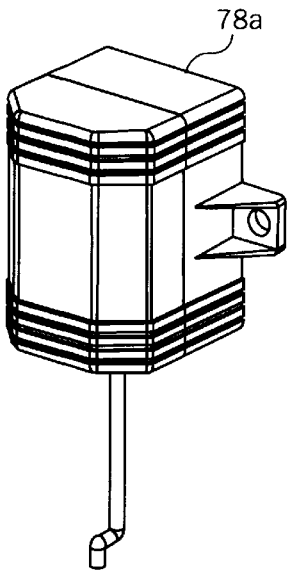
FIG. 5 is an isometric view of an embodiment having a plastic housing.
Figure 7:
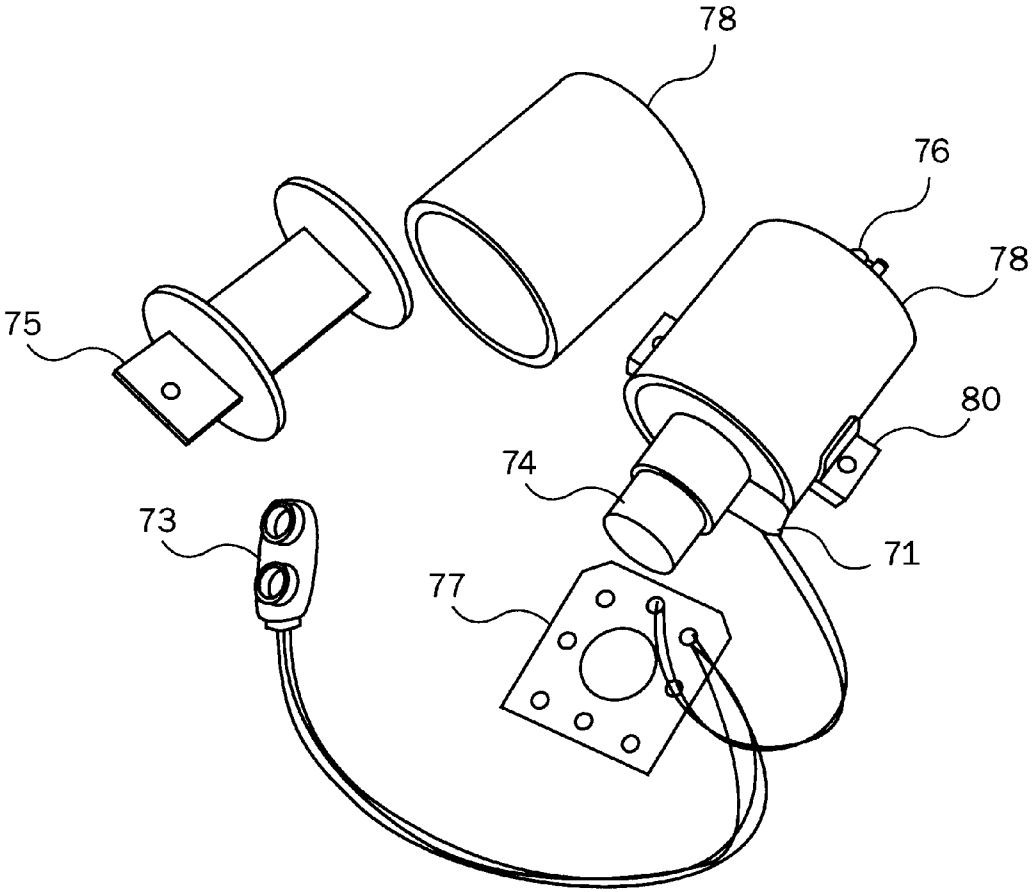
FIGS. 7 and 8 are expanded isometric views of an alternate embodiment having a plastic housing.
Figure 8:
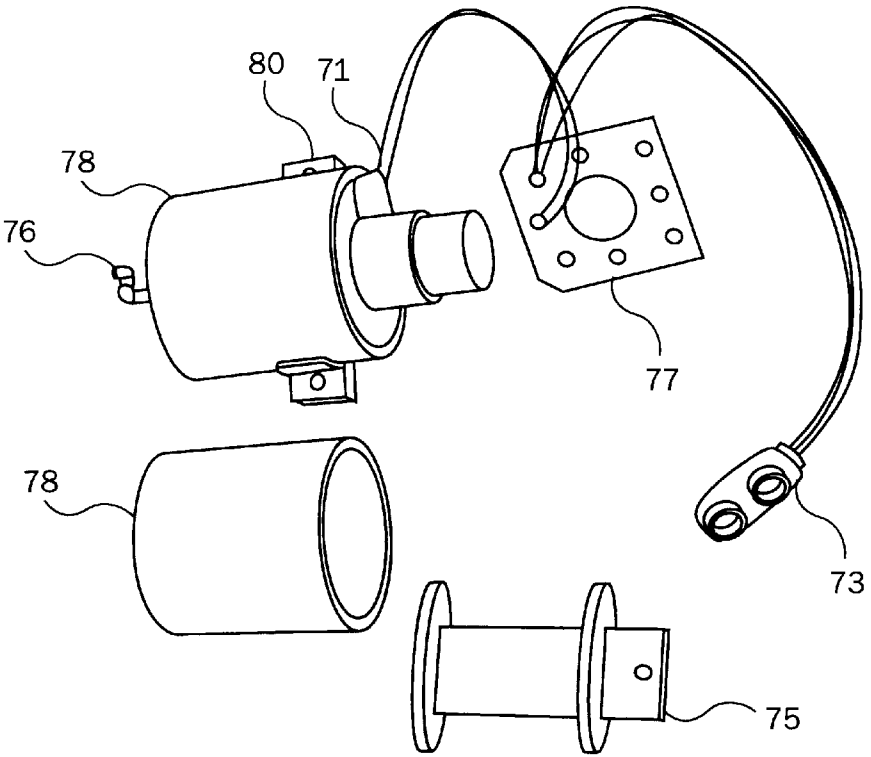

FIGS. 5 and 6 show an alternate embodiment in which the ferrous metal housing 78 has been replaced by a housing 78*a* made from a non-ferrous material, such as: aluminum, zinc alloy, acrylonitrile butadiene-styrene ("ABS"), polytetrafluoroethylene ("PTFE"), polystyrene, polyethylene, and polyester. These embodiments may include a return spring 79 that biases the actuator rod 72 back to its equilibrium position. This return spring 79 should be configured such that increased throttle displacements (i.e., opening the throttle) create an increased spring force in the opposite direction. Accordingly, if an interruption of power occurs, the resulting decrease in force generated by the linear actuator 24 allows the return spring 79 to automatically close the throttle valve 32. Those skilled in the art will recognize that the return spring 79 can be linear, torsional, or some other type, depending upon the specifics of the system.

The linear actuator 24 embodiment of the present invention has a magnet position where the driving magnetic flux induced by the coil 70 is at a high overall strength and where this strength is relatively constant across a travel distance. It is this position of semi-constant flux strength that is used for the fixed linear travel distance of the actuator 24. Because this travel distance is fixed and limited, the valve 32 and the method of linkage 28 should be chosen so that they can effectively maintain a desired engine RPM under various load conditions within the actuator's 24 range. Accordingly, butterfly style valves 32 are particularly desirable for this application because they are inexpensive and because they require relatively little actuating motion. However, other types of throttle valves 32 can be used to control the fuel-air mixture and are within the scope of this invention.

Figure 4:
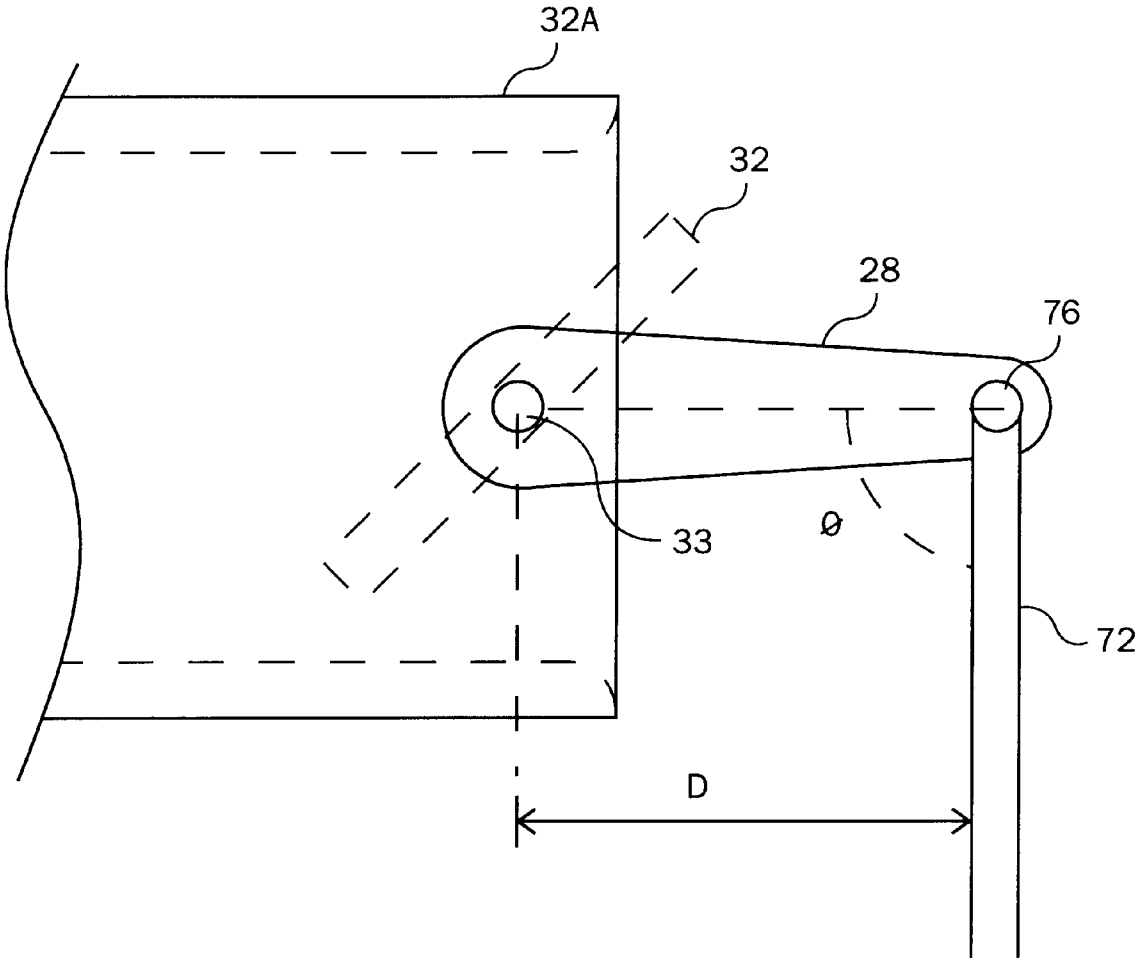
FIG. 4 is a side view of a throttle valve with control linkages for use in the present invention.

FIG. 4 shows one appropriate linkage for converting the linear motion of the actuator rod 72 into the rotary motion of the butterfly style throttle valve 32 (typically located at the base of carburetor body 32A). The amount of angular movement of the rotary butterfly valve 32 can be adjusted by changing the distance ("d") between the butterfly valve's center of rotation 33 and a linkage point 76 of the actuator rod 72. This change also affects the torque available to actuate the valve 32. By properly setting this distance ("d"), the actuator 24 can be used to control RPM at any desired speed between idle and full load. This includes a position where it acts as a traditional full load RPM controller (i.e., a governor). In addition, it is desirable that the angle ("θ") between the linkage 28 and the actuator rod 72 close to 90 degrees when the IC engine 36 is operating at its normal, expected speed because this angle will maximize the sensitivity of the controller 16. It is also noted that the actuator rod 72 moves circumferentially at the point of linkage between the actuator rod 72 and the butterfly valve 32, and linearly at the effective center point of the magnet(s). This may require an actuator rod 72 with some angular play.

Referring again to FIG. 1, the controller 16 in this embodiment calculates the actual engine speed for the engine speed signal 40 by sensing and measuring the timing between the engine's 36 spark plug activations ("firings"). This method is desirable because the spark plug firings are easily detected and are directly related the actual velocity. However, other methods of measuring engine speed are within the scope of the present invention. This specifically includes, without being limited to, the use of an appropriate transducer that senses rotations of the engine's distributor rotor or output shaft.

The previously described embodiments of the present invention have many advantages over known generator control methods. For example, the present invention provides a low-cost engine controller that can maintain a desired engine speed at various loads and that can reduce engine speed to idle at desired times as specified by an operator. These advantages make the present invention particularly desirable for controlling small portable generators of the type generally powered by a 0.5 to 10 horsepower IC engine and purchased for home emergency or recreational vehicle use. The present invention is also desirable because it includes a microprocessor that can be used for other functions, such as emission control. It is further realized that the use of state variable estimation techniques will eliminate the need for a throttle position sensor, thereby further reducing cost. Also, the present invention is desirable because the return force caused by magnetic hysteresis effects and/or by the return spring 79 automatically reduces engine speed if its power supply to the controller 16 ever fails. This automatic fail safe feature improves safety and can extend the generator's expected life.

The present invention may be embodied in other specific forms without departing from the essential spirit or attributes thereof. For example, the present invention could be modified to directly sense and control the output frequency of the generator. The controller 16 in this embodiment would produce a signal related to the difference between the actual output frequency and 60 hertz. In addition, although the described embodiments generally refer to portable generators, it can be seen by one knowledgeable in the art that this invention can, with the proper software, be applied to other operating systems that use IC engines and even to mechanical systems that do not use IC engines.

Accordingly, those skilled in the art will recognize that the accompanying figures and this description depicted and described embodiments of the present invention, and features and components thereof. With regard to means for fastening, mounting, attaching or connecting the components of the present invention to form the mechanism as a whole, unless specifically described otherwise, such means were intended to encompass conventional fasteners such as machine screws, nut and bolt connectors, machine threaded connectors, snap rings, screw clamps, rivets, nuts and bolts, toggles, pins, and the like. Components may also be connected by welding, soldering, brazing, friction fitting, adhesives, or deformation, if appropriate. Unless specifically otherwise disclosed or taught, materials for making components of the present invention were selected from appropriate materials, such as metal, metallic alloys, fibers, polymers, and the like; and appropriate manufacturing or production methods, including casting, extruding, molding, and machining, may be used. In addition, any references to front and back, right and left, top and bottom and upper and lower were intended for convenience of description, not to limit the present invention or its components to any one positional or spacial orientation. Therefore, it is desired that the embodiments described herein be considered in all respects as illustrative, not restrictive, and that reference be made to the appended claims for determining the scope of the invention.

What is claimed is:

1. An apparatus for controlling a speed of an engine, comprising:

a controller that generates a plurality of voltage pulses related to a difference between a desired engine speed and an actual engine speed; and a linear actuator that converts the plurality of voltage pulses into a throttle position, the linear actuator comprised of an actuator rod, a solenoid coil and a ferrous metal housing, wherein the plurality of voltage pulses generates a current in the solenoid coil which generates a magnetic field to generate an actuating force, the actuating force biasing the actuator rod in a first direction and wherein the metal housing interacts with a magnet to generate a return force.

2. The apparatus of claim 1, wherein the return force biases the actuator rod in a second direction.

3. The apparatus of claim 1, and further comprising an engine speed sensor in communication with the controller.

4. The apparatus of claim 1, and further comprising pulse width modulator in communication with the controller.

5. The apparatus of claim 1, wherein the actuator valve is coupled to a throttle valve.

6. The apparatus of claim 1, wherein the controller is a feed back controller.

7. The apparatus of claim 1, wherein the controller uses a control method selected from the group consisting of proportional control, integral control, differential control, phase land control, phase lag control, state variable or feed forward control.

8. An apparatus for controlling an internal combustion engine, comprising:

(a) a controller operatively connected to an engine speed sensor and adapted to produce a signal related to a difference between an actual engine speed and a desired engine speed;

(b) a pulse width modulator that generates a plurality of voltage pulses having a duration and frequency related to the signal from the controller; and (c) a linear actuator assembly that converts the plurality of voltage pulses into a throttle position, the linear actuator assembly comprising:

a solenoid coil, electrically coupled to the pulse width modulator, that generates a linear actuation force during the plurality of voltage pulses, wherein the linear actuation force translates an actuator rod in a first direction;

a linkage that couples the actuator rod to a throttle valve; and a ferrous metal sleeve magnetically coupled to a magnet adapted to generate a return force between the plurality of voltage pulses, wherein the return force translates the actuator rod in a second direction.

* * * * *